US006163593A

United States Patent [19]

Koller et al.

[11] Patent Number: 6,163,593

[45] Date of Patent: Dec. 19, 2000

[54] SHAPED TARGET FOR MAMMOGRAPHY

[75] Inventors: Thomas Koller, Salt Lake City; Rajesh Bhandari, Midvale; Scott Coles, Salt Lake City; Wayne Truong, West Jordan; Jeffrey Takenaka, Salt Lake City, all of Utah

[73] Assignee: Varian Medical Systems, Inc., Palo Alto, Calif.

[21] Appl. No.: 09/138,106

[22] Filed: Aug. 21, 1998

[51] Int. Cl.[7] ..... H01J 35/10

[52] U.S. Cl. ..... 378/144; 378/125; 378/143

[58] Field of Search ..... 378/37, 119, 125, 378/143, 144

[56] References Cited

U.S. PATENT DOCUMENTS 4,052,640 10/1977 Hueschen et al. ..... 378/144

5,303,281 4/1994 Koller et al. ..... 378/134

5,511,105 4/1996 Knott ..... 378/134

FOREIGN PATENT DOCUMENTS 1045149 11/1953 France ..... 378/144

*Primary Examiner*—David P. Porta

*Attorney, Agent, or Firm*—Workman, Nydegger & Seeley

[57] ABSTRACT

A method and apparatus for reducing off-focus radiation by modifying a shape of a rotating target anode disposed within a cathode grounded x-ray tube. The shape of the target anode body is modified such that surfaces of the target anode which could otherwise direct the greatest amounts of off-focus radiation toward an x-ray sensitive imaging device are angled or shortened so as to redirect the off-focus radiation away from a focal direction. These modifications to surfaces of the target anode body include modifying a front surface, a side or edge surface, and a back surface.

15 Claims, 6 Drawing Sheets

SHAPED TARGET FOR MAMMOGRAPHY

FIELD OF THE INVENTION

The present invention relates to x-ray tube technology and, in particular, to targets used in x-ray generating equipment. More specifically, this invention pertains to a new x-ray tube rotating anode target design which has improved performance characteristics which enable the rotating anode to reduce off-focus radiation, while achieving higher resolution, greater clarity, and low density contrast as compared to state of the art cathode grounded x-ray tubes.

BACKGROUND OF THE INVENTION

State of the art x-ray tube rotating target anodes can be categorized as one of two types; anode grounded and cathode grounded. Anode grounded x-ray tubes are more expensive to produce because of a complicated stainless steel vacuum envelope and cathode structure. Furthermore, the power supplies that are required to operate such tubes are more complicated and expensive because the filament and some control circuitry are at a high potential (up to 50 kilovolts). However, the anode grounded x-ray tubes generally provide clearer images as compared to cathode grounded x-ray tubes. This is because the anode grounded structure and the associated steel vacuum envelope collect many of the scattered electrons that would otherwise strike the target and generate undesirable off-focus radiation. However, the uncollected scattered electrons which manage to strike the target anode produce off-focus x-rays. These off-focus x-rays reduce image clarity by increasing the background film blackening without producing an image.

Cathode grounded x-ray tubes are less expensive to produce because of simpler vacuum envelopes and cathode structures. In addition, the power supplies are considerably less expensive because the filament and all control circuitry can be operated at or near ground potential. The trade-off comes in performance. The cathode grounded x-ray tube generally suffers several times the amount of off-focus or extra-focal radiation because most scattered electrons return to the target anode and produce undesirable x-rays. The resulting x-ray images are more fogged than images from anode grounded x-ray tubes. Despite these drawbacks, they are often ignored in light of the substantial cost savings of the cathode grounded x-ray tube design.

It would be advantageous to be able to provide a cathode grounded x-ray tube which could produce x-ray images on screen or film which are comparable to the clarity of images from anode grounded x-ray tubes.

The present invention is designed to overcome the problems presented by off-focus x-ray radiation. Off-focus radiation is also referred to as extra-focal radiation. Focal radiation is radiation that carries information to the film or screen making the x-ray image. Extra-focal radiation is produced by electrons which are back scattered from the target focal spot and land on the x-ray tube target. But as is understood, a significant source of extra-focal radiation is produced by electrons which strike a rotating target anode in areas other than a focal spot toward which electrons are directed. Any radiation generated outside of the focus spot can only degrade the diagnostic image generated on the film. It is noted that film also refers to any other x-ray sensitive image device or surface.

FIG. 1 shows a target anode 20 which is ready to be disposed within an x-ray tube assembly. The target anode 20 generates extra-focal radiation from electrons 8 which "rebound" from near a focal spot 24 and fall back to the target anode 20 outside of a focal area 23. Wherever these electrons 8 land on the target anode 20, they produce x-rays. Because these x-rays are almost as penetrating as those from the focal spot 24, the deliberate addition of filtration between the target anode 20 and an x-ray sensitive film will generally not significantly improve matters. These electrons 8 can even curve all the way around to a back face of the target anode 20, and then generate off-focus radiation.

The problem of off-focus radiation is not insignificant in its severity. FIG. 2 is provided as an image of extra-focal radiation as seen by a pin-hole camera. The dark spot 6 in the middle of the image is radiation from the focal spot 24 (FIG. 1). However, not only an outline but an entire image of the target anode 20 is clearly visible in profile. Thus, there is substantial off-focus radiation being generated which reduces resolution, clarity and contrast of resulting x-ray images. Furthermore, the effect is much more pronounced for rotating target anodes than for stationary anodes because of the greater area of tungsten or tungsten carbide generally involved. In the stationary target anode tube design, much of the rebounding electron shower falls on copper, thus resulting in a lower level of extra-focal radiation.

FIG. 3 is provided as a more detailed illustration of a typical prior art cathode grounded x-ray tube assembly 10 which shows the features which are most relevant to the present invention. There are other tilt angles and designs. Nevertheless, depending upon the mammography system design, the x-ray housing 12 of the cathode grounded x-ray tube assembly 10 is usually tilted at an angle 15 of about six degrees with respect to a horizontal plane 14. The exact tilt of the x-ray housing 12 and a resulting target angle 16 of the target anode 20 is determined by an x-ray source-to-film distance 18. In this figure, the target angle 16 is chosen to be at a sixteen degree angle relative to a common or central axis 39 of the target anode 20 and the x-ray housing 12.

FIG. 3 also shows the possible paths that x-rays can travel from the target anode 20 to an x-ray sensitive imaging device 22. In this case, the x-ray sensitive imaging device 22 is shown as a portion of an x-ray sensitive imaging device. Ideally, the only radiation from the target anode 20 that strikes the x-ray sensitive imaging device 22 would be x-rays generated at the focal spot 24. The width of a path of x-rays generated from the focal spot 24 is delineated by solid lines 26. Therefore, the portion of the x-ray imaging sensitive device 22 which is of concern to the present invention falls between the path represented by the solid lines 26. The extent of coverage of the x-ray sensitive imaging device 22 is thus shown as width 28.

If the focal spot 24 was the only source of radiation which would impinge upon the x-ray sensitive imaging device 22, there would be less problems with the quality of x-ray images generated thereby. However, FIG. 1 also shows other surfaces of the target anode 20 which function as undesirable sources of radiation (off-focus radiation) which can strike the x-ray sensitive imaging device 22. Specifically, a back face 30, an edge face 32, a target face 33 and even the front face 34 of the target anode 20 are all off-focus radiation sources. It should also be mentioned that portions of a focal spot track 36 (not seen in this profile view of the target anode 20), which at any given moment are not the focal spot 24, can also be a source of off-focus radiation.

Having identified the off-focus radiation producing surfaces 30, 32, 33 and 34 of the target anode 20, it is now useful to see the possible paths that the radiation can follow from all these surfaces to the x-ray sensitive imaging device 22. A possible path of off-focus radiation from the back face 30 is shown as dotted lines 36. Possible paths of off-focus radiation from the edge face 32 are shown as dotted lines 38 (a path also partially shared with dotted line 36). Finally, a possible path of off-focus radiation from the target face 34 is shown as dotted line 40. All of these paths 36, 38, and 40 are possible routes for x-rays to travel from the target anode 20 to the x-ray sensitive imaging device 22. What is important to observe is that all the paths fall within the desired extent of coverage 28 of radiation from the focal spot 24. This desired extent of coverage 28 can also be referred to as a focal direction.

Therefore, what is needed is a way to reduce off-focus or extra-focal radiation when using a rotating target anode in a cathode grounded x-ray tube. It would be a further advantage to increase the clarity of x-ray images generated by such an x-ray tube as compared to anode grounded x-ray tubes.

One method for reducing off-focus radiation used in the prior art is to dispose various apertures between the target anode and an x-ray sensitive imaging system. Strategic placement of apertures attempts to limit radiation which is coming from off-focus radiation sources on the target anode. Unfortunately, for various reasons this method also causes other problems, making it only partially effective for off-focus radiation reduction. Therefore, what is also needed is a way to decrease off-focus radiation at the source of most x-ray emissions, the target anode.

It is an object of the present invention to provide a method and apparatus for reducing off-focus radiation of a target anode in a cathode grounded x-ray tube.

It is another object to provide a method and apparatus for achieving higher resolution in x-ray images generated from the present invention as compared to state of the art cathode grounded x-ray tubes.

It is another object to provide a method and apparatus for achieving greater clarity in x-ray images generated from the present invention as compared to state of the art cathode grounded x-ray tubes.

It is another object to provide a method and apparatus for achieving lower density contrast in x-ray images generated from the present invention as compared to state of the art cathode grounded x-ray tubes.

It is another object to provide a method and apparatus for reducing off-focus radiation from a target anode used in a cathode grounded x-ray tube by modifying a shape of the target anode.

It is another object to provide a method and apparatus for reducing off-focus radiation from a target anode used in a cathode grounded x-ray tube by modifying angles of the target anode so that scattered electrons which generate off-focus radiation from the target anode are not directed towards an x-ray sensitive imaging device.

It is another object to prove a method and apparatus for reducing off-focus radiation from a target anode used in a cathode grounded x-ray tube such that x-ray images generated therefrom are comparable to x-ray images generated by anode grounded x-ray tubes.

It is another object to provide a method and apparatus for reducing off-focus radiation from in a cathode grounded x-ray tube by reducing the off-focus radiation at the source.

It is another object to provide a method and apparatus for reducing off-focus radiation from a target anode used in a cathode grounded x-ray tube by modifying widths of surfaces which can generate the off-focus radiation

SUMMARY OF THE INVENTION

The present invention is embodied in a method and apparatus for reducing off-focus radiation by modifying a shape of a target anode which rotates within a cathode grounded x-ray tube. The shape of the target anode is modified such that surfaces of the target body which could otherwise direct the greatest amounts of off-focus radiation toward an x-ray sensitive imaging device are angled or shortened so as to redirect the off-focus radiation in a more advantageous direction, or limit the amount of off-focus radiation that can be produced. These modifications to surfaces of the target body include modifying a front surface, a target surface, an edge surface and a back surface. The back surface may comprise a central portion and an end sloped portion.

According to one aspect of the present invention, a slope of the front surface, the edge surface, and the back surface is modified to redirect off-focus radiation away from the x-ray sensitive imaging device.

According to another aspect of the present invention, a single surface of the target anode can be modified to also produce beneficial results in reducing off-focus radiation, achieving higher resolution, greater clarity, and low density contrast in an x-ray image.

According to yet another aspect of the present invention, modifying slopes of target body surfaces also results in reduction of total target anode mass.

These and other objects, features, advantages and alternative aspects of the present invention will become apparent to those skilled in the art from a consideration of the following detailed description taken in combination with the accompanying drawings.

DETAILED DESCRIPTION OF THE INVENTION

Reference will now be made to the drawings in which the various elements of the present invention will be given numerical designations and in which the invention will be discussed. It is to be understood that the following description is only exemplary of the principles of the present invention, and should not be viewed as narrowing the claims which follow.

The present invention is an apparatus and a method for improving x-ray images produced by a cathode grounded x-ray tube. The improved resolution, clarity and contrast of x-ray images are generally comparable to those produced by more expensive anode grounded x-ray tubes. The present invention is able to achieve these results by modifying the shape of a target anode body.

Figure 3:
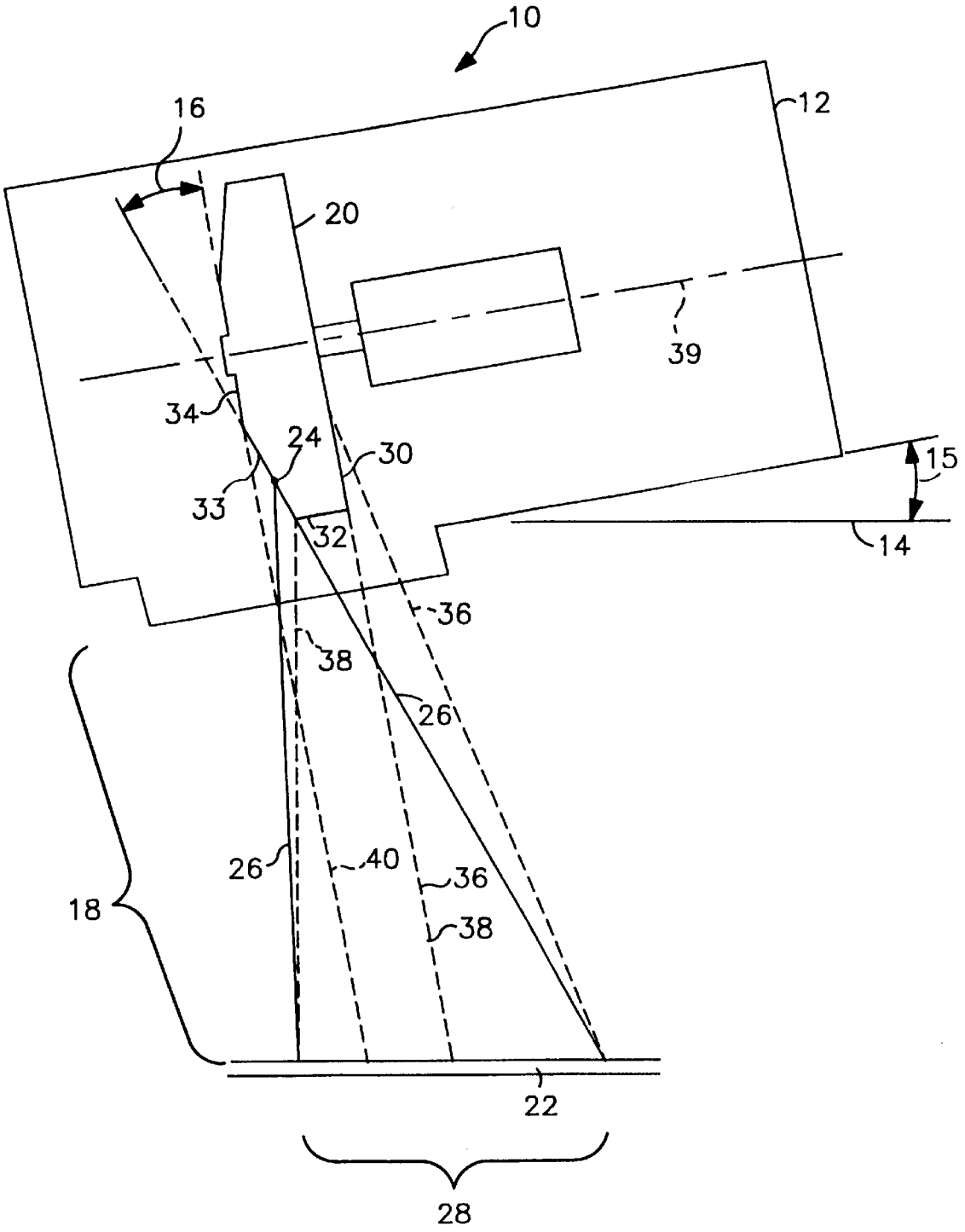
FIG. 3 PRIOR ART
FIG. 3 is a profile view of portions of a cathode grounded x-ray tube as is commonly found in the state of the art. The x-ray tube has a rotating anode target disposed therein for generating x-rays which can produce an image on an x-ray sensitive imaging device.
Figure 4B:
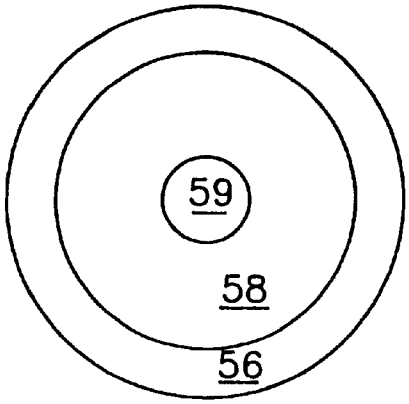
FIG. 4B is a top view of the target anode of FIG. 4A, which shows how the surfaces appear from a top-down perspective.
Figure 4A:
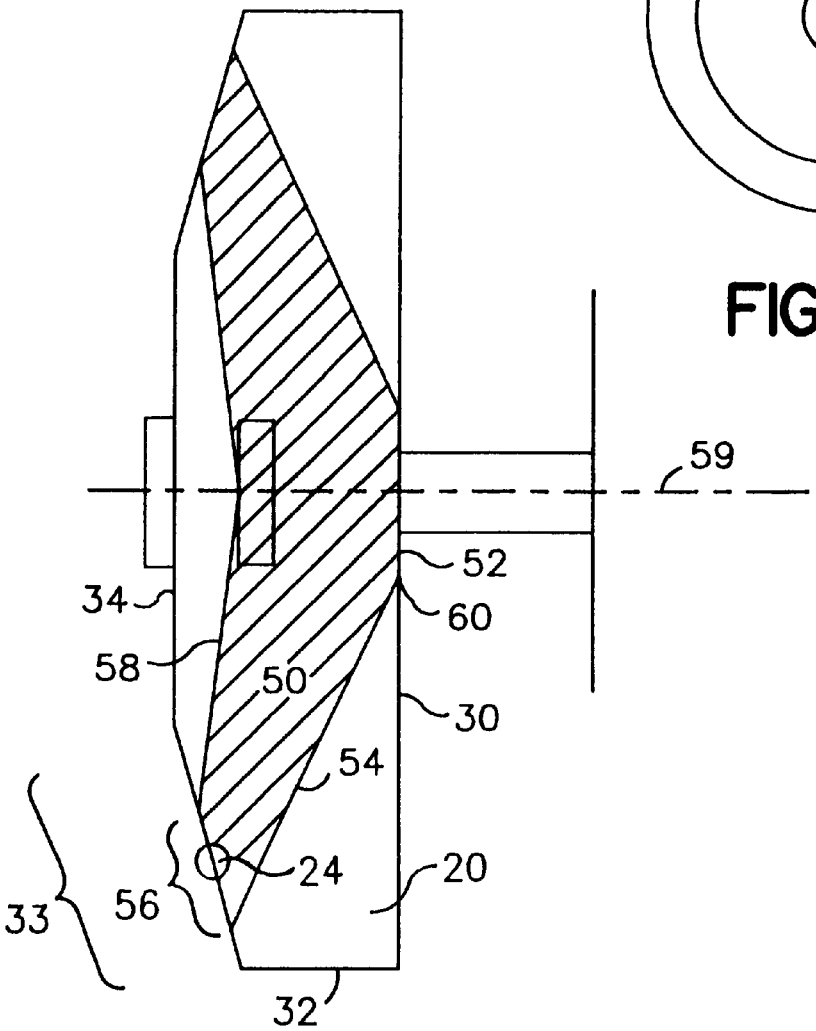
FIG. 4A is a close-up profile view of a target anode as used in the prior art which has superimposed thereupon an image of a presently preferred embodiment of a target anode, to thereby illustrate the modifications to the front, target, edge, and back surfaces of the target anode.

FIG. 4A is a close-up profile outline of a target anode 20 as used in the prior art which has superimposed thereon an image of a presently preferred embodiment of a target body 50. The purpose of FIG. 4A is to contrast the shape of the target anode 20 shown in FIG. 3 and the target anode body 50 of the present invention. The back surface 30, the edge surface 32, the target surface 33, and the front surface 34 of the state of the art target anode 20 are easily recognizable.

To summarize, the modifications to these surfaces in the presently preferred embodiment are two-fold, width and angles (slopes). First, a central portion 52 of a back surface of the target body 50 is substantially reduced in width. In contrast, the peripheral portion 54 of the back surface of the target body 50 is now substantially longer than in the state of the art design. Most importantly, the peripheral portion 54 of the back surface is now at a different angle with respect to the edge surface 32. A target surface 56 of the preferred embodiment is also shortened in width with respect to the target surface 33. Finally, the width of the front surface 58 is widened and the angle changed with respect to the front surface 34.

Figure 1:
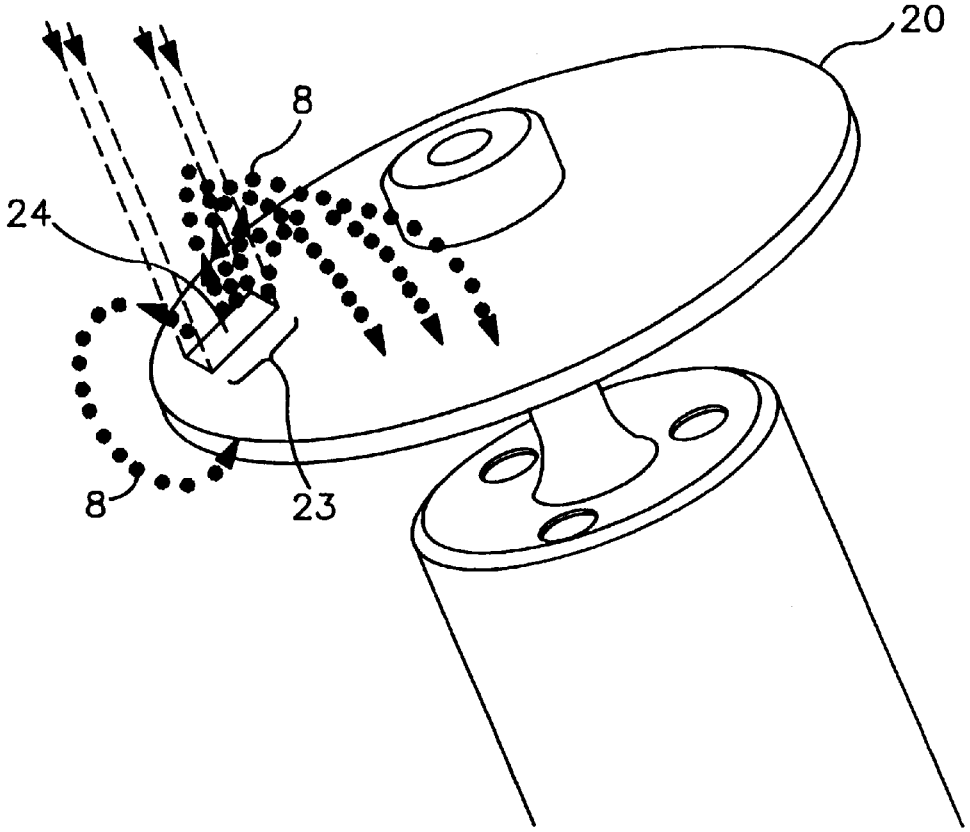
FIG. 1 PRIOR ART
FIG. 1 is a perspective illustration of a target anode used in the prior art which shows the path of scattered electrons (the dots) which strike the target anode, and then disperse in various directions to consequently strike the target anode at locations other than the focal spot, thereby generating off-focus radiation which impinges upon an x-ray sensitive imaging device.
Figure 2:
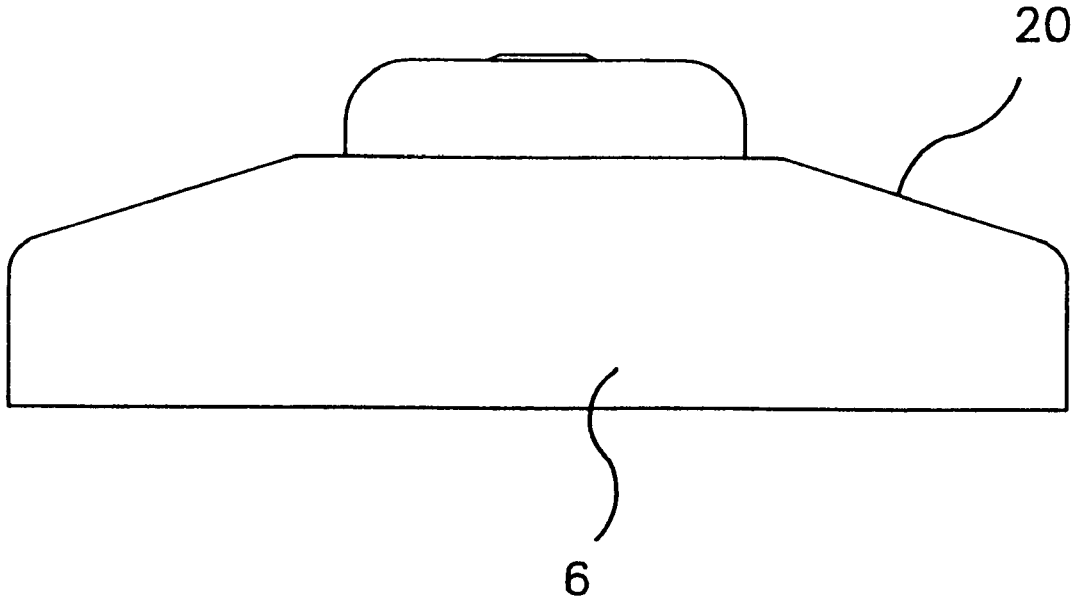
FIG. 2 PRIOR ART
FIG. 2 is an x-ray image produced using a pin-hole aperture type of camera to thereby show the off-focus radiation which is typical when using an x-ray tube as shown in FIG. 3. The radiation in this image appears as darkened areas.

The reduced off-focus radiation from the central portion 52 of the back surface is a result of two aspects. First, while the angle of the central portion 52 is not changed (still parallel to a plane of the target body, which is perpendicular to a central axis of rotation 59), the width is substantially shortened. The second aspect of the change is that the distance from a beginning point 60 of the central portion 52 is much further away from the scattering electrons which are generally being produced at a location near to the focal spot 24 as shown in FIG. 1. In effect, the reduced width of the central portion 52 of the back surface of the preferred embodiment of the target body, and its distance from scattering electrons from the focal spot 24 substantially reduces, if not altogether eliminates, any significant off-focus radiation from the central portion 52 of the back surface.

The actual width of the central portion 52 is generally going to be a function of an angle that the peripheral portion 54 of the back surface needs to make, and is therefore not specified. In other words, the width is the result of forming the peripheral portion 54 at a desired and advantageous angle.

The reduced off-focus radiation from the peripheral portion 54 is a result of its new angle, not its width. While the width of the peripheral portion 54 of the back surface is substantially increased, a new and advantageous angle with respect to placement of an x-ray sensitive imaging device results in the off-focus radiation being directed away.

The specific angle of the peripheral portion 54 of the back surface with respect to a plane defined by the central portion 52 of the back surface is shown in this preferred embodiment as being at approximately 25 degrees. However, it should be apparent that this angle can be modified. A useful range of angles made by the peripheral portion 54 of the back surface with respect to the central portion 52 of the back surface can be greater than 0 degrees and up to approximately 40 degrees.

The reduced off-focus radiation from the target surface 56 is strictly a result of a change in width. The target surface 56 which has the focal spot 24 is shortened to reduce off-focus radiation. This target surface 56 is reduced because the electrons generating the off-focus radiation are scattered from this location. Reducing the size of the target surface 56 reduces the number of electrons that can be scattered to create the off-focus radiation. It should be observed that the shortening of the width of the target surface 56 results in a corresponding increase in the width of the front surface 58.

In addition to the widening of the front surface 58 of the target body 50, the front surface 58 is now slightly angled inwards toward the target body 50 as the front surface 58 approaches the central axis 59 about which the target body 50 rotates. The angle made by the front surface 58 also advantageously redirects off-focus radiation away from an x-ray sensitive imaging device.

FIG. 4B is provided as context for what is seen when looking at the top or front surface 58 and target 56 surface of the target body 50. When viewed from this position, the surfaces are circular disks. When viewed from the side as in FIG. 4B, it is realized that the surfaces actually follow the contours of flattened and truncated cones, the front surface being an inverted cone (an inverted conical depression), having an inner circular perimeter and an outer circular perimeter.

Figure 5:
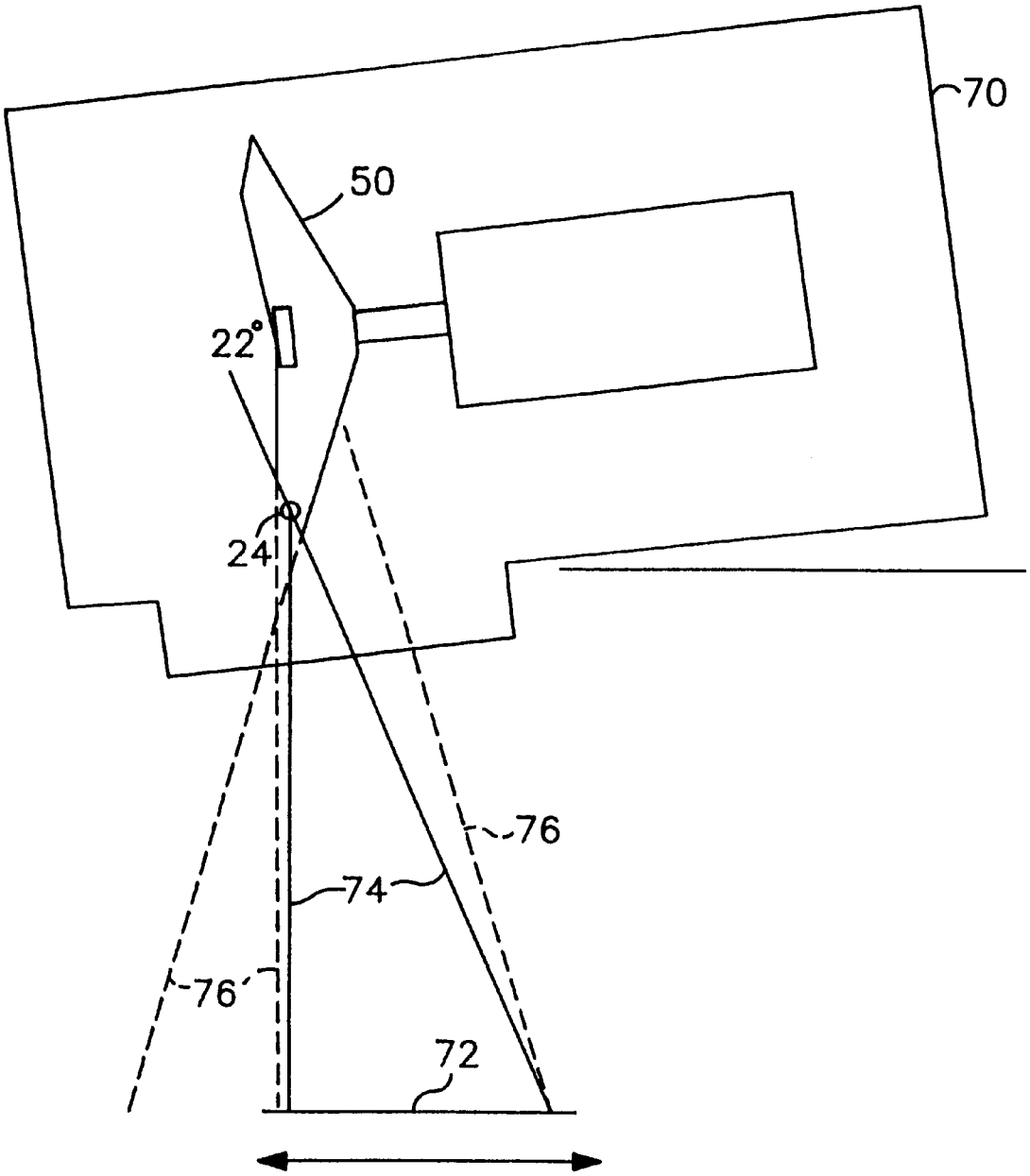
FIG. 5 is a profile view of the presently preferred embodiment of a rotating target anode from FIG. 4A but which is now shown disposed within a cathode grounded x-ray tube, and which is made in accordance with the principles of the present invention.

Having shown the close-up view of the presently preferred target body 50, it is now useful to view the target anode in context within an x-ray tube. Accordingly, FIG. 5 is provided as an elevated profile view of the presently preferred embodiment for a new cathode grounded x-ray tube 70 which is constructed in accordance with the principles of the present invention. The target body 50 is shown as it is typically positioned within the cathode grounded x-ray tube 70. A first observation is that the target body 50 is positioned within the cathode grounded x-ray tube 70 just as in the state of the art x-ray tube shown in FIG. 3. The only readily apparent difference in structure is the shape of the target body 50.

However, there is a significant difference in performance of the target anode 50. This performance difference is manifest as a substantial reduction in the off-focus radiation generated therefrom. This is graphically demonstrated by the solid and dotted lines which represent paths of radiation from the target anode to an x-ray sensitive imaging device 72.

The solid lines 74 represent the maximum width of the path for the focal radiation being generated from the focal spot 24 to the x-ray sensitive imaging device 72. The dotted lines 76 show the likely paths of off-focus radiation from several surfaces. The observation is made that all of the dotted lines indicate that most of the off-focus radiation is generally directed away from the x-ray sensitive imaging device 72, thus resulting in the most obvious advantages of the present invention.

The embodiment of the target anode body 50 shown in FIG. 4A includes all of the changes which are made to the widths and angles of the surfaces of the target body 50. However, it should be apparent that the changes alter the performance characteristics of the target anode of the present invention in other ways. For example, the mass of the target body 50 is substantially reduced because of the change in the width and angle of the peripheral portion 54 of the back surface. One result is that the motor needed to rotate the target anode can be smaller because there is less inertia to overcome. Another result is that the target anode of the present invention can also reach a desired rotational speed more rapidly. This results in a decrease in what is referred to as "time to speed". However, with the reduced mass, the target anode may get hotter.

Though the target anode 50 may deal with a reduction in heat capacity, it should be realized that there are improvements in the materials being used in target anodes as well as improved methods of thermal energy transfer. Consequently, the thermal transfer characteristics or heat sink capacity of target anodes is increasing. These materials and methods could provide a sufficient compensation for the reduced mass of the target anode.

The alternative embodiments of the present invention allow for increasing heat sink capacity of the target anode.

In another alternative embodiment, the central portion 52 of the back surface of the target body 50 might be eliminated altogether by extending a width of the peripheral portion 54 of the back surface.

Figure 6:
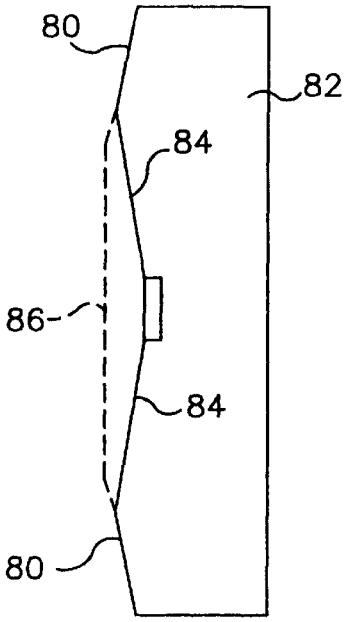
FIG. 6 is an alternative embodiment of the target anode of FIG. 4A, with only the front surface and the target surface of the target anode being modified to redirect and reduce off-focus radiation.

The alternative embodiment is shown in FIG. 6. FIG. 6 shows a target anode which only makes a change in a target surface 80 and a front surface 84 of a target anode body 82 compare to the prior art anode target. The target surface 80 is shortened, and the front surface 84 becomes longer and is then angled inward towards the target anode to thereby redirect the off-focus radiation from the front surface. This is the same change made in the target surface 56 and the front surface 58 of FIG. 4A. For comparison purposes, an outline using a dotted line 86 is provided to show the original shape of a state of the art target anode such as the one shown in FIG. 3. This alternative embodiment retains most of the substantial heat sink capabilities of the original target anode because the back and edge surfaces have not been changed.

This alternative embodiment is a trade-off between the enhanced x-ray images which can be obtained from the target anode of FIGS. 4A and 5, and the heat sink capabilities of the target anode of FIG. 3. The off-focus radiation will thus be reduced by the amount contributed by the target surface 80 which is shortened, and the front surface 58 which is now widened and angled.

It should be obvious from the explanations given above that the back and edge surfaces could also be modified while not changing the front surface.

Figure 7:
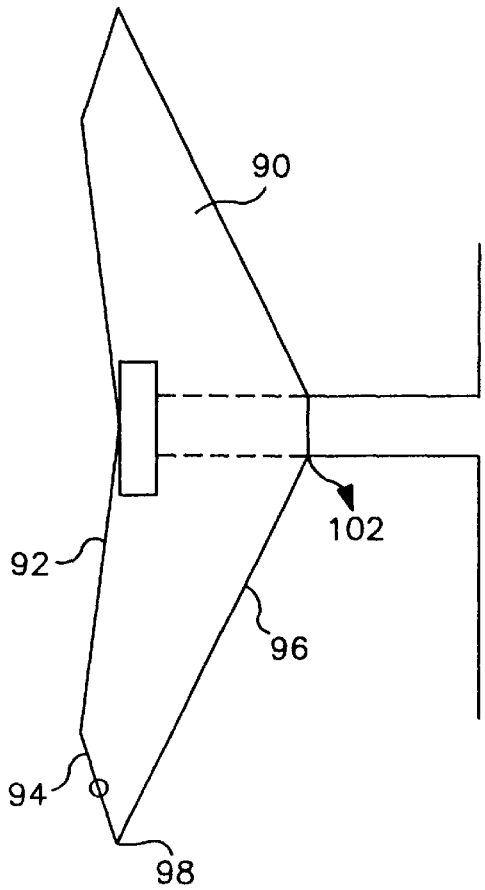
FIG. 7 is an alternative embodiment of the present invention which eliminates the short back surface of FIG. 4A.

FIG. 7 is an alternative embodiment of the target anode of FIG. 4A. The difference between this embodiment and the preferred embodiment is in the back surface of the target anode. Specifically, target anode body 90 is shown with a front surface 92, a target surface 94, and a back surface 96. Notice that the back surface 96 extends without interruption from an outer target anode edge 98, all the way to an aperture edge 102. This alternative embodiment eliminates the central portion of 52 of the back surface (FIG. 4A) which was a narrow shelf capable of directing off-focus radiation to the in a focal direction.

Figure 8:
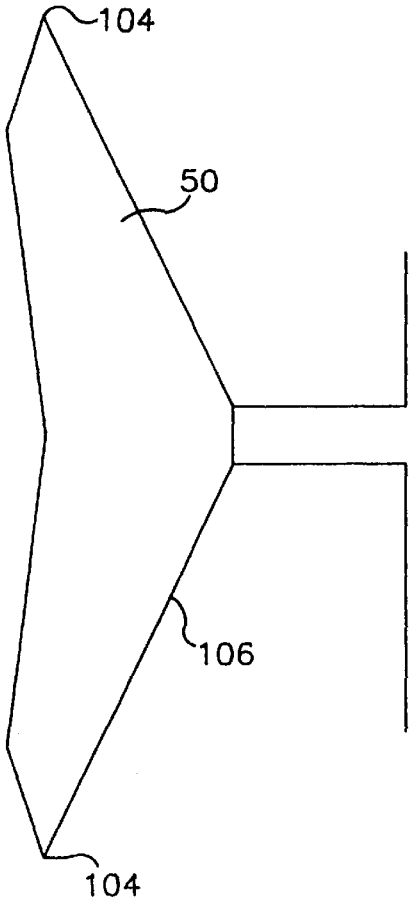
FIG. 8 is another alternative embodiment of the present invention which provides for a small width being provided in the target anode.

FIG. 8 is yet another alternative embodiment of the present invention. It is possible that an edge surface 104 on the target anode body might be necessary to provide some height. For example, the height might be necessary because of manufacturing constraints, heat sink capabilities, or other such reasons. Therefore, FIG. 8 is provided as an illustration of this added height.

It is important to note that the edge surface 104 is either minimized in size (as shown) to reduce off-focus radiation, or it is also angled, but at a different angle relative to that of the back surface 106.

It is to be understood that the above-described embodiments are only illustrative of the application of the principles of the present invention. Numerous modifications and alternative arrangements may be devised by those skilled in the art without departing from the spirit and scope of the present invention. The appended claims are intended to cover such modifications and arrangements.

What is claimed is:

1. A target anode disposed in a cathode grounded x-ray tube comprising:

a symmetrical target body having a central axis of rotation, a front surface, a back surface, a target surface and a central opening extending from said front surface to said back surface along said central axis, said front surface facing a cathode of the x-ray tube being formed as an inner surface of a first inverted truncated cone protruding outwards the cathode, said back surface being opposite to said front surface and formed as an outer surface of a second inverted truncated cone protruding in a direction of said first inverted cone;

said target surface being formed as an outer surface of a third truncated cone protruding in an opposite direction of protrusions of said first and second inverted cones and disposed between said first and second inverted truncated cones, said target surface comprising a focal spot track for receiving electrons from the cathode and generating x-ray radiation in a focal direction, and said first, second and third cones being coaxial therebetween.

2. The target anode of claim 1, wherein said back surface further comprising a central portion which is perpendicular to said central axis of said target body and an end sloped portion, wherein x-ray radiation generated therefrom is distributed away from said focal direction.

3. The target anode of claim 2, wherein said front surface is inclined from said opening relative to a plane of said target body which is perpendicular to said central axis and forms an angle $\theta$ therewith, where $0° < \theta < 20°$.

4. The target anode of claim 2, wherein said target surface is inclined relative to a plane of said target body which is perpendicular to said central axis and forms an angle $\theta$ therewith, where $0° < \theta < 30°$.

5. The target anode of claim 2, wherein said end sloped portion of said back surface is inclined from said central opening relative to a plane of said target body which is perpendicular to said central axis and forms an angle $\theta$ therewith, $0° < \theta < 40°$.

6. The target anode of claim 2, wherein said end sloped portion of said back surface is inclined from said central portion relative to a plane of said target body which is perpendicular to said central axis and forms and angle $\theta$ therewith, where $0° < \theta < 30°$.

7. The target anode of claim 6, further comprising an edge surface which is disposed between said target surface and the back surface, said edge surface is slanted for distributing x-ray radiation generated therefrom away from said focal direction.

8. An x-ray tube used for mammography comprising an evacuated envelope with a grounded cathode and an anode target opposing said cathode, said anode target comprising:

a symmetrical target body having a central axis of rotation, opposed front and back surfaces, and a central opening extending therethrough along said central axis, said front surface comprising a peripheral target portion for generating x-ray radiation upon bombardment by an electron beam produced by said cathode and a central portion, said peripheral target portion being formed as a truncated cone coaxial with said central axis and projecting outwards said central opening, said central portion being formed as a truncated cone coaxial with the central axis of said disk and projecting towards said central opening, said central and target portions tapering towards each other for redirecting distribution of x-ray radiation generated from said central portion;

said back surface being formed as a truncated cone coaxial with said central axis and projecting in a direction of said truncated cone of said central portion of said front surface, and said back surface and said target portion of said front surface being tapered towards each other for redirecting x-ray radiation generated from said back surface.

9. The x-ray tube of claim 8, wherein said back surface further comprising a central portion and a peripheral portion tapering towards said central portion, said central portion being perpendicular to said central axis of said target body.

10. The x-ray tube of claim 9, further comprising an edge surface which is disposed between said target portion of said front surface and said peripheral portion of said back surface, said edge surface being slanted towards said target portion and said peripheral portion of said back surface for redirection x-ray radiation generated therefrom.

11. A method for reducing off-focus radiation generated from a target anode used in a cathode grounded x-ray tube, comprising the steps of:

providing said target anode in a form of a symmetrical body having opposed front and back surfaces and a central opening therethrough, each of said surfaces comprising a central portion and abutting thereto peripheral portion and wherein an edge surface is disposed between the peripheral portion of said front and back surfaces;

forming the central portion of said front surface as a first truncated inverted cone projecting towards said central opening and the peripheral portion as a second truncated inverted cone projecting in a direction opposite to said first cone and being coaxial with said second cone and a central axis of said body, providing X-ray focal spot on the peripheral portion of said front surface;

forming the peripheral portion of said back surface as a third truncated inverted cone projecting in the direction of the first cone and being coaxial with said first and second cones, and the central portion of said back surface perpendicular to the central axis of said body; and distributing x-ray radiation generated from said central portion of said front surface and back surface away from a direction of x-ray radiation generated from said X-ray focal spot that is directed incident to an x-ray sensitive imaging device by providing angles that the central portion of said front surface, and the peripheral portion of said back surface make relative to a plane of an x-ray sensitive imaging device.

12. The method of claim 11 further comprising the step of providing an angle between said edge surface and the plane of said x-ray sensitive imaging device for distributing x-ray radiation generated therefrom in a direction away from x-ray radiation generated by said x-ray focal spot.

13. A method for reducing off-focus radiation generated from a target anode used in a cathode grounded x-ray tube, comprising the steps of:

providing a target anode in a form of a cylindrical disk having a front surface and a back surface;

forming a target surface along an outer periphery of the front surface of the disk that meets with the back surface of the target anode to form an interface edge therewith, and wherein the target surface is angled so as to emit x-rays substantially in a predetermined direction towards an x-ray sensitive imaging device; and forming a central portion along the front surface between the target surface and the central axis of the disk, wherein at least a portion of the central portion is angled so as provide a decreasing slope towards the central axis of the disk so that x-rays emitted from the central portion are emitted substantially in a direction away from the x-ray sensitive imaging device.

14. A method as defined in claim 13, wherein the interface edge is substantially square.

15. A method as defined in claim 13, wherein the interface edge is formed at an angle such that the back surface forms an angle less than approximately 40 degrees measured with respect to a plane that is perpendicular with the central axis of the disk.

* * * * *

UNITED STATES PATENT AND TRADEMARK OFFICE

CERTIFICATE OF CORRECTION

PATENT NO. : 6,163,593
DATED : December 19, 2000
INVENTOR(S) : Thomas Koller, Rajesh Bhandari, Scott Coles, Wayne Truong and Jeffrey Takenaka It is certified that error appears in the above-identified patent and that said Letters Patent is hereby corrected as shown below:

Column 7,
Line 52, after "the front surface" change "58" to -- 84 --
Line 67, before "in a focal direction" delete "to the"

Column 8,
Lines 41 and 42, after "being coaxial" change "ther-ebetween" to -- there-between --
Line 64, after "central axis and forms" change "and" to -- an --

Column 9,
Line 32, after "further" change "comprising" to -- comprises --

Column 10,
Line 41, after "angled so as" insert -- to --

Signed and Sealed this

Sixteenth Day of April, 2002

*Attest:*

*Attesting Officer*

JAMES E. ROGAN
*Director of the United States Patent and Trademark Office*